US005306012A

United States Patent [19]

Fujita

[11] Patent Number: 5,306,012

[45] Date of Patent: Apr. 26, 1994

[54] SIMULATION TRAINING DEVICE

[76] Inventor: Kazuyuki Fujita, 1-7-15, Denenchofu, Ota-ku, Tokyo, Japan

[21] Appl. No.: 18

[22] Filed: Jan. 4, 1993

[51] Int. Cl.[5] ..... A63B 69/36

[52] U.S. Cl. ..... 273/187 R; 273/187.6; 273/35 A

[58] Field of Search ..... 273/35 A, 187.6, 183.1, 273/187 R, 187 A, 29 A, 26 R; 434/252

[56] References Cited

U.S. PATENT DOCUMENTS 3,000,261 9/1961 Frenkel ..... 273/35 A X

*Primary Examiner*—George J. Marlo

*Attorney, Agent, or Firm*—Paul A. Fattibene; Arthur T. Fattibene

[57] ABSTRACT

The present invention is a simulation training device in which a user's form can be so corrected as to coincide with a correct form displayed on a TV screen, a resin film of a pale dark color is mounted on one surface of a transparent convex member to form a half mirror, an enlarging lens is arranged on the back surface of the half mirror and joined therewith, and the half mirror is supported by legs adjustable in height and at an angle.

7 Claims, 3 Drawing Sheets

SIMULATION TRAINING DEVICE

BACKGROUND OF THE INVENTION

This invention relates to a simulation training device and, more particularly, to a simulation training device for allowing a user to correctly swing while so correcting his own swinging form for a golf, a baseball, a tennis or the like, as to coincide his own swinging form with a television (heretofore referred to as "a TV") image by enlarging his swinging form from a TV screen, imaging his swinging form on a half mirror and further imaging an instructor's swinging form together on the half mirror by standing in front of the half mirror while swinging.

DESCRIPTION OF THE PRIOR ART

Heretofore, there is no simulation training device of this type. Therefore, a technical subject to be solved must be studied to so train a user's swinging form by enlarging a TV image of a correct swinging form, imaging the swinging form, and correcting his own swinging form to so train as to coincide his own switching form with the correct swinging form, and an object of this invention is to provide a simulation training device which solves the technical subject described above.

SUMMARY OF THE INVENTION

The present invention has been proposed so as to perform the above-described object. There is provided a simulation training device comprising a half mirror having a resin film of a pale dark color mounted on one surface of a transparent convex member, an enlarging lens arranged on a back surface of the half mirror and joined to the half mirror, and one or more legs so mounted as to be adjustable in height and at a longitudinal angle.

In this invention, an image of a correct swinging form is previously formed on a video film. Normally, the image is so formed as to be a reverse image. In the case where the image is not reverse, a TV set having a switch for converting the image reversely on a TV screen is employed, the image is reversely converted by the operation of the switch and displayed on the screen.

The video film associated with the TV set is displayed as the image on the TV screen by turning ON the TV set. At this time, the simulation training device of this invention adjusted in height and at a longitudinal angle is disposed in front of the TV set. When a user observes the half mirror by standing toward the simulation training device, the image of the video film is enlarged and displayed on the half mirror. The moving direction of the swinging form is the same as that of the user standing in front of the half mirror. Then, when the user sets, for example, an image of the video film to a correct swinging form for a golf, the correct swinging form is enlarged and displayed on the half mirror. Simultaneously, an instructor also swings in front of the half mirror, displays his swinging form on the half mirror, and the user so repeats training of the swinging as to coincide the own swinging form with the TV image. Then, the user can naturally train the correct swinging form for the gold.

DETAILED DESCRIPTION OF PREFERRED EMBODIMENTS

Figure 1:
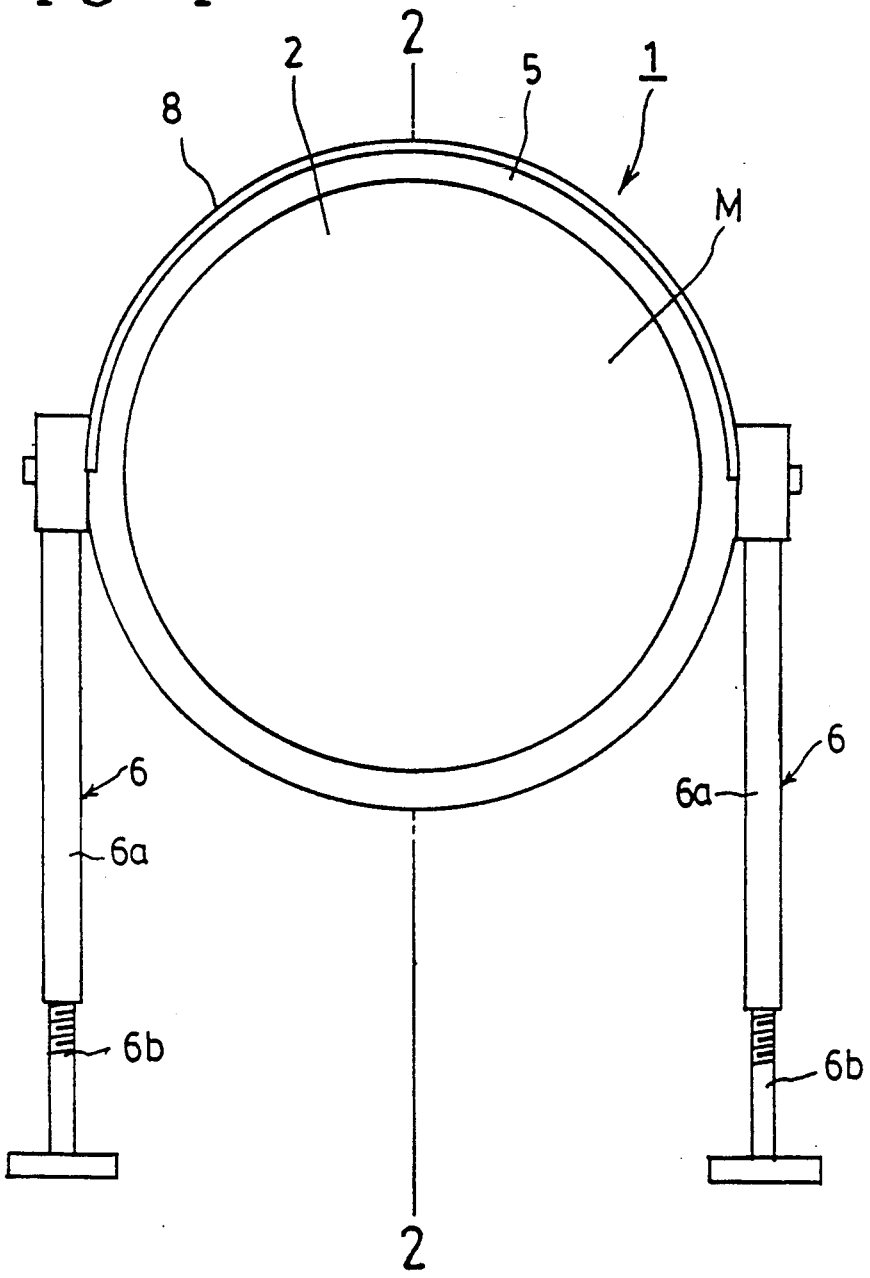
FIG. 1 is a front view of a simulation training device according to the present invention.
Figure 2:
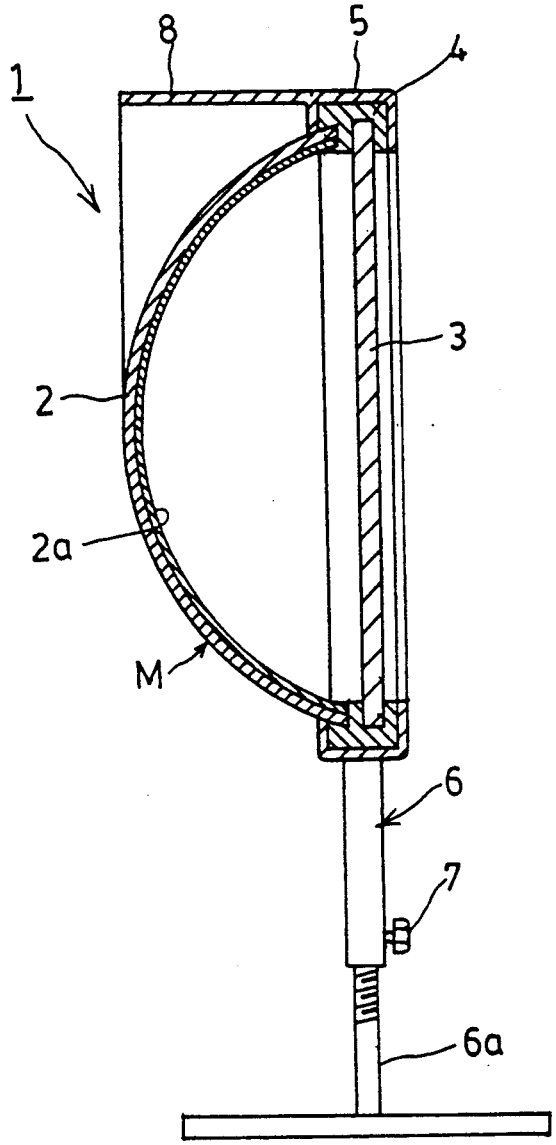
FIG. 2 is a sectional view taken along the line 2—2 of FIG. 1.
Figure 3:
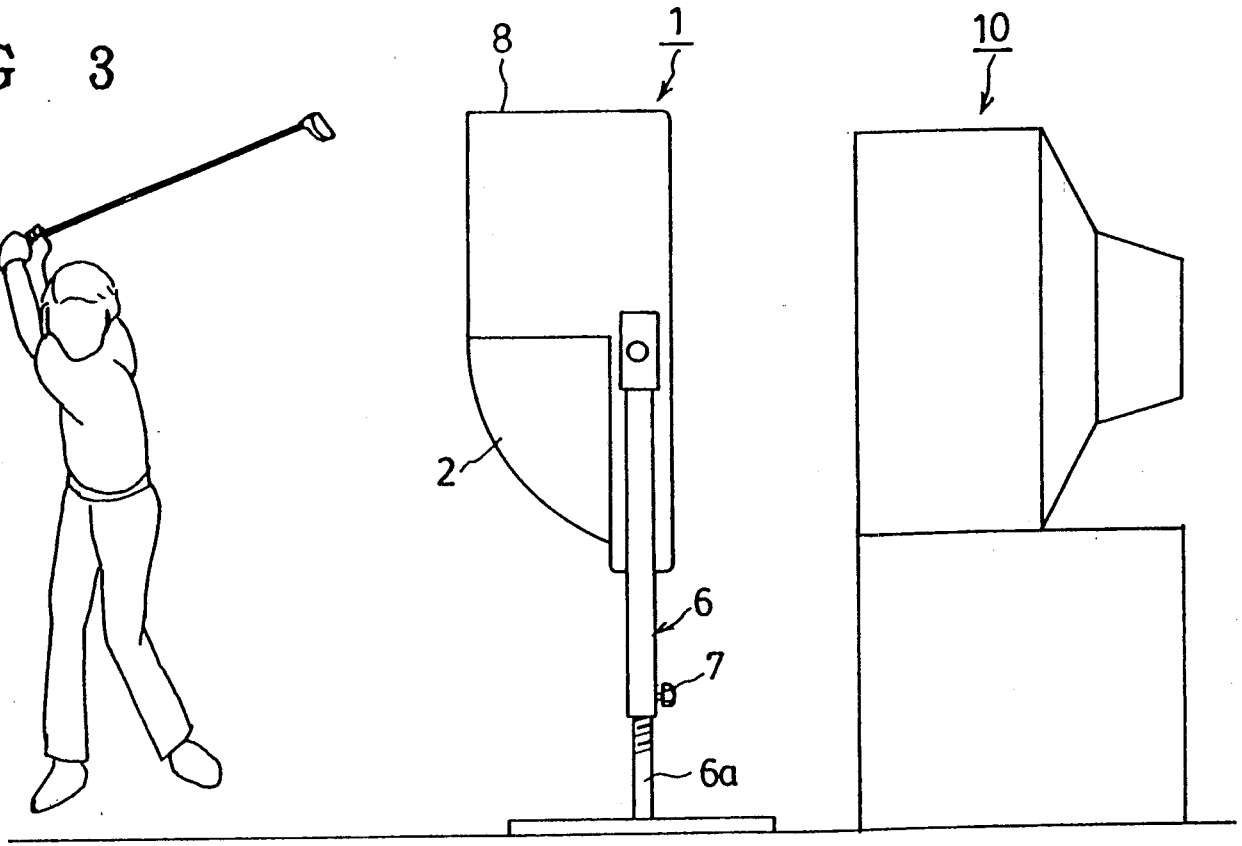
FIG. 3 is an explanatory side view showing a training state of the device of the invention.

An embodiment of the present invention will be described with reference to FIGS. 1 to 3. In the drawings, reference numeral 1 denotes a simulation training device of the present invention. In the simulation training device 1, a transparent convex member 2 is arranged on a front surface, and an enlarging lens 3 is arranged on a back surface. Further, a resin film 2*a* of a pale dark color is mounted on one surface of the transparent convex member 2 to form a half mirror M, and the periphery of the half mirror M is joined to the enlarging lens 3 through an elastic member 4. The elastic member 4 is covered with a metal ring 5. Legs 6 and 6 are provided at right and left side faces of the metal ring 5. Each of the legs 6, 6 is adjusted in height by engaging a cylinder 6*a* having female and male threads with a shaft piece 6*b* having male and female threads to be engaged with the female and male threads of the cylinder 6*a*, and fixed in height by a bolt 7 attached to the cylinder 6*a*. The half mirror M is adjustable at an angle in a longitudinal direction. Therefore, when a user stands in front of the half mirror M to do swinging, the user's swinging operation is contracted and displayed on the half mirror. It is noted that means for adjusting in height and at an angle is not particularly limited as illustrated.

In the embodiment described above and illustrated in the drawings, a hood 8 is mounted on an upper half of the half mirror M so as to clarify the image displayed on the half mirror M. However, the present invention is not limited to the particular embodiment. For example, the hood 9 is not always necessary.

Then, when a user trains by using the simulation training device of the present invention, a video film (not shown) having an image of a correct form is previously manufactured. The video film is associated with the TV set 10. Further, the simulation training device 1 of the present invention is disposed in front of the TV set 10 by arbitrarily adjusting the height and the angle thereof. When the TV set 10 is then turned ON, the image of the video film is displayed on the TV screen, the image on the TV screen is further enlarged by the enlarging lens 3, and displayed on the half mirror M. Then, when the user stands in front of the half mirror M and trains himself to coincide with the correct form displayed on the half mirror M, his operating form is contracted and displayed on the half mirror M. Therefore, he can naturally train and master a correct form by so correcting himself as to coincide the own image with the TV image.

According to the present invention as described in detail above with respect to the embodiment thereof, the correct form is previously manufactured on the video film, the image of the video is displayed on the TV screen, the user stands in front of the simulation training device of the present invention disposed in front of the TV set, adjusts the height and the angle of the simulation training device to match the instructor, and then turns ON the TV set. Then, the image displayed on the TV screen is enlarged by the enlarging lens, and displayed on the half mirror. At this time, the operation becomes reverse on the half mirror to become the same direction as the instructor's operation. Therefore, the instructor moves himself to coincide with the image displayed on the half mirror. Thus, since the user's own movement is contracted and displayed on the half mirror, he can repeat training so as to coincide the own form with the correct form and naturally train and master the correct form.

Therefore, when the simulation training device of the present invention is used, the user can simulate all the forms of sports such as a golf, a baseball, a tennis, a Ping-Pong (trade mark), as well as a dancing, a social dance or the like, and naturally master the correct form.

The present invention may be variously modified within the scope of the spirit of the present invention, and the modifications thereof will be naturally included in the scope of the present invention.

I claim:

1. A simulation training device comprising:

a transparent convex member;

a color resin film affixed to a surface of said convex member forming a half mirror;

lens means, placed adjacent the back surface of said convex mirror, for displaying an enlarged image onto said convex member; and adjusting means, attached to said convex member, for adjusting the position of said convex member, whereby a previously recorded reverse image located at the back of said convex member is projected on said convex member together with a reflection of the user on the front of the convex member so that the user can train.

2. A simulation training device as in claim 1 wherein: said color resin film is a pale dark color.

3. A simulation training device as in claim 1 wherein: said adjusting means is at least one adjustable leg.

4. A simulation training device as in claim 1 further comprising:

image means, placed adjacent said enlarging lens, for projecting a reverse video image onto the rear of said convex member.

5. A method of training comprising the steps of:

projecting a reverse video image onto the rear of a half mirrored convex member;

standing in front of the half mirrored convex member; and adjusting the half mirrored convex member so that a projected reverse video image coincides with a user's image, whereby the user can view the video image and the user's image simultaneously in order to train.

6. A simulation training device comprising:

a transparent convex member;

a pale dark color resin film affixed to a surface of said convex member forming a half mirror;

lens means, placed adjacent the back surface of said convex mirror, for displaying an enlarged image onto said convex member;

video image means, adjacent said lens means, for producing a reverse video image;

height adjusting means, attached to said convex member, for adjusting the height of said convex member; and angle adjusting means, attached to said convex member and said height adjusting means, for adjusting the angle of said convex member, whereby said video image means projects a previously recorded reverse video image of an instructor on the back of said convex member to be matched to a reflection of the user on the front of the convex member so that the user can train.

7. A simulation training device as in claim 6 further comprising:

a hood placed over the upper half said convex member.

* * * * *